US005197813A

United States Patent [19]

Asano

[11] Patent Number: 5,197,813

[45] Date of Patent: Mar. 30, 1993

[54] CONTROL OF RIBBON FEED DURING ERASING IN AN IMPACT PRINTER

[75] Inventor: Shinya Asano, Tokyo, Japan

[73] Assignee: Canon Kabushiki Kaisha, Tokyo, Japan

[21] Appl. No.: 915,863

[22] Filed: Jul. 20, 1992

Related U.S. Application Data

[63] Continuation of Ser. No. 471,070, Jan. 29, 1990, abandoned, which is a continuation of Ser. No. 138,043, Dec. 28, 1987, abandoned.

[30] Foreign Application Priority Data

Jan. 7, 1987 [JP] Japan ..... 62-464
Feb. 27, 1987 [JP] Japan ..... 62-42786

[51] Int. Cl.[5] ..... B41J 29/26
[52] U.S. Cl. ..... 400/697.1; 400/232
[58] Field of Search ..... 400/216.1, 225, 227.2, 400/232, 695, 696, 697, 697.1

[56] References Cited

U.S. PATENT DOCUMENTS 3,741,364 6/1973 Becker ..... 400/216.1
3,997,046 12/1976 Wolowitz ..... 400/697.1
4,268,181 5/1981 Decker ..... 400/697.1
4,492,485 1/1985 Gall ..... 400/697
4,611,938 9/1986 Rettke ..... 400/227.2
4,753,542 6/1988 Moritz et al. ..... 400/697

FOREIGN PATENT DOCUMENTS 84886 5/1982 Japan ..... 400/232
229380 12/1984 Japan ..... 400/232
125688 7/1985 Japan ..... 400/232
192677 10/1985 Japan ..... 400/697.1
9978 1/1987 Japan ..... 400/232
2161756 1/1986 United Kingdom ..... 400/227.2

*Primary Examiner*—David A. Wiecking
*Attorney, Agent, or Firm*—Fitzpatrick, Cella, Harper & Scinto

[57] ABSTRACT

An impact printer for recording onto a sheet by striking an ink ribbon and for correcting the recorded data by striking a correction ribbon. The printer comprises: a platen to support a recording sheet; a print hammer to strike a recording ink ribbon and a correction ribbon onto the sheet; a supply reel to feed the ink ribbon; a first memory to store ink ribbon feeding amounts in the case where the ink ribbon and correction ribbon are overlaid and struck by the recording head to thereby correct the recorded data; a controller to control the supply reel on the basis of the ink ribbon feeding amount stored in the first memory and to feed the ink ribbon upon correction; and a second memory to store types of correction ribbons. The controller reads out the ink ribbon feeding amount from the first memory on the basis of the type of the correction ribbon and changes the ink ribbon feeding amount of the supply reel in accordance with the type of recording ribbon which is used. The mechanism to lift up and down the ink ribbon and correction ribbon is provided on only one side of the carriage. With this printer, the ink ribbon can be efficiently used upon correction and the up/-down mechanism of the ribbons can be simplified.

10 Claims, 9 Drawing Sheets

CONTROL OF RIBBON FEED DURING ERASING IN AN IMPACT PRINTER

This application is a continuation of U.S. patent application Ser. No. 07/471,070, filed Jan. 29, 1990, which is a continuation of U.S. patent application Ser. No. 07/138,043 filed Dec. 28, 1987, both now abandoned.

BACKGROUND OF THE INVENTION

1. Field of the Invention

The present invention relates to an impact type printer for recording onto a sheet by striking an ink ribbon and for correcting the recorded data by striking a correction ribbon.

2. Related Background Art

In an impact printer, e.g., a daisy wheel printer, an ink ribbon for recording is interposed between a type wheel and a recording sheet and the recording is performed onto the recording sheet by striking the type wheel using a hammer. This daisy wheel printer is frequently used in an electronic typewriter. In general, although typewriters need a recording correcting function, in the case of using the daisy printer, a correction ribbon different from an ink ribbon is used in place of the ink ribbon and the correction ribbon is struck by a hammer in the same manner as in the recording, thereby accomplishing the correcting function.

As mentioned above, in the typewriter, it is typical that the recording ink ribbon and the correction ribbon are provided and the mechanisms to lift up and down the respective ribbons are provided so that each ribbon alternately comes to the striking position when recording and correcting.

However, due to recent cost reductions, a printer in which the up/down mechanism of the ribbons is as simplified as possible has been proposed. Such a printer uses a system in which when the correcting operation is performed, the ink ribbon is not lifted up or down but is left at the striking position, while the correction ribbon is shifted to the striking position and both ribbons are struck by the hammer. At this time, even if both ribbons are struck by the hammer, since the correction ribbon is located on the side nearest the recording sheet, the correcting operation is not influenced by the presence of the ink ribbon.

With this construction, the up/down mechanism of the ink ribbon can be omitted and the cost can be reduced. However, on the contrary, there is an inconvenience such that each time the correction is performed, the ink ribbon must be fed. This is because each time the ink ribbon is struck, it is damaged and if the ink ribbon is struck many times, it will be cut out.

SUMMARY OF THE INVENTION

It is an object of the present invention to provide an impact printer in which the unused portion of a recording ribbon when the correcting operation is performed can be reduced as little as possible.

Another object of the invention is to simplify the up/down mechanism of a correction ribbon.

The above and other objects and features of the present invention will become apparent from the following detailed description and the appended claims with reference to the accompanying drawings.

BRIEF DESCRIPTION OF THE DRAWINGS

FIG. 9 is a block diagram; and

FIG. 10 is a flowchart for a control procedure.

DESCRIPTION OF PREFERRED EMBODIMENTS

The present invention will be described in detail hereinbelow with respect to an embodiment with reference to the drawings.

Figure 1:
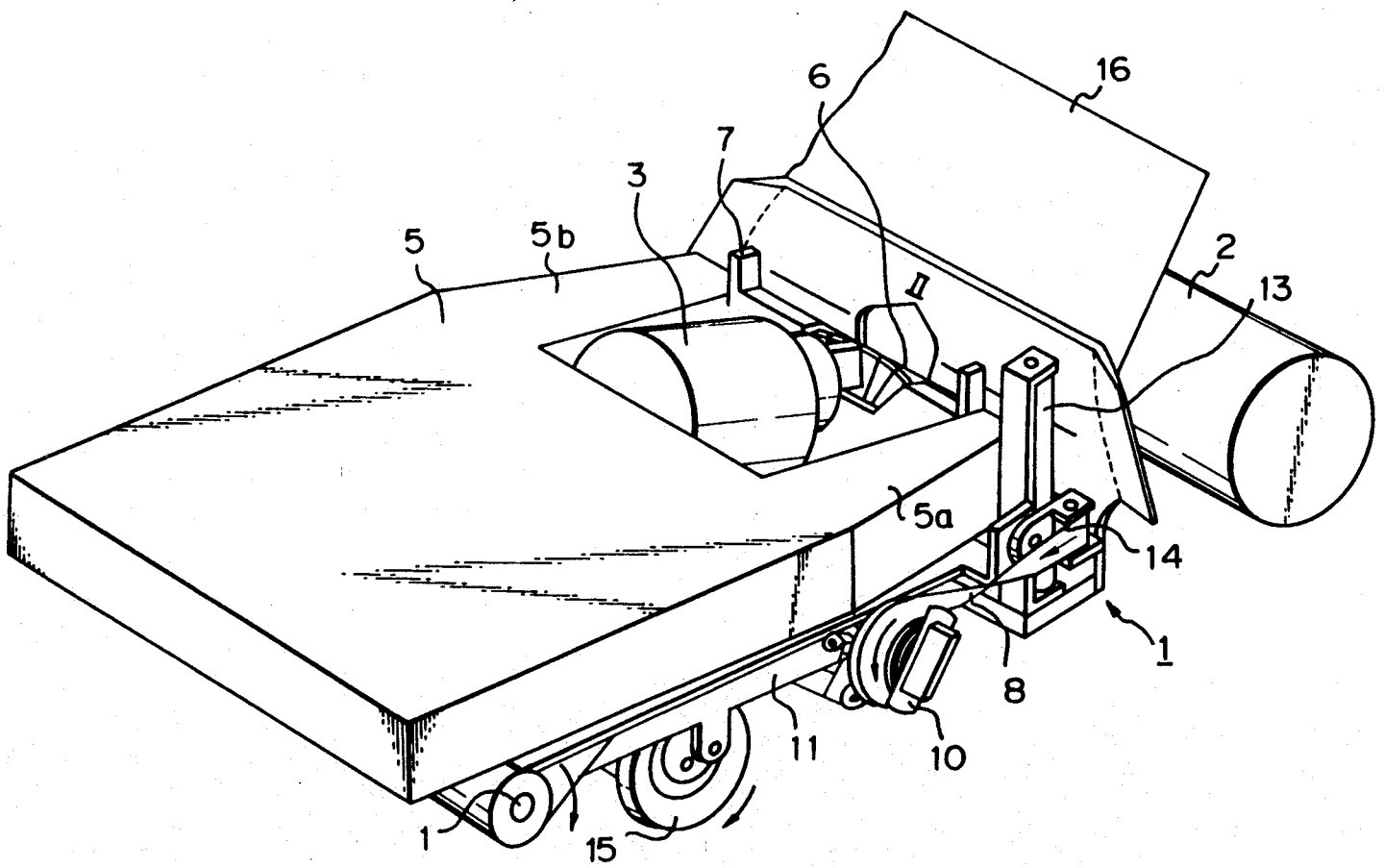
FIG. 1 is a perspective view when seen from the take-up reel side.
Figure 2:
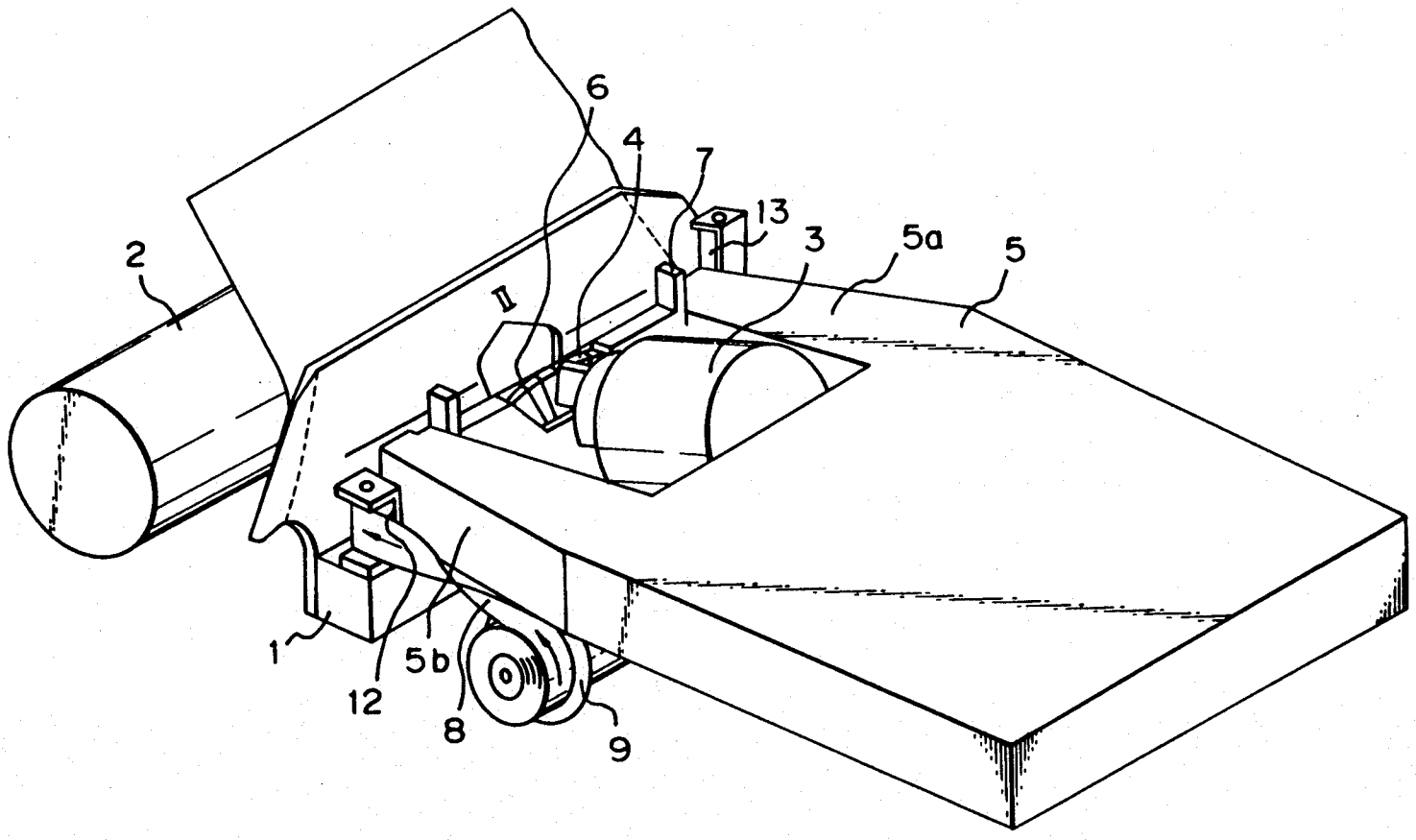
FIG. 2 is a perspective view when seen from the supply reel side.

FIGS. 1 and 2 are perspective views showing the main sections in a recording apparatus as an impact printer according to the invention. In the diagrams, a carriage 1 is slidably attached to a guide axis (not shown) and is reciprocated along a platen 2. A print hammer 3 is mounted on the carriage 1 and faces a daisy wheel 4.

On the other hand, an ink ribbon cassette 5 is detachably disposed on the carriage 1. An ink ribbon 6 pulled out from the side of one arm 5*a* is taken up to the side of the other arm 5*b* by a ribbon feed motor (not shown). However, the ink ribbon located between the arms 5*a* and 5*b* is supported by ribbon guides 7 and passes through a gap formed between the daisy wheel 4 and the recording paper. A supply reel 9 is rotatably attached to the left side of the carriage 1. A correction tape (or correction ribbon) 8 is detachably attached to the supply reel 9.

Rollers 12 and 13 are rotatably attached to the printing side of the carriage 1. On the other hand, a rotary arm 11 is rotatably attached on the right side of the carriage 1. A roller 14 is rotatably attached to the end of the rotary arm 11. A take-up reel 10 for taking up the correction ribbon is rotatably attached at the middle position of the rotary arm 11. The arm 11 is vertically lifted up or down by a cam 15 which is rotated by a cam motor (not shown).

The correction ribbon 8 pulled out from the supply reel 9 is supported by the rollers 12 and 13 and held so as to pass between the platen 2 and the ink ribbon 6. The correction ribbon 8 then passes through the roller 14 attached to the rotary arm 11 and is taken out to the take-up reel 10 by a correction ribbon feed motor (shown as correction tape feed motor 27 in FIG. 7A).

Figure 3:
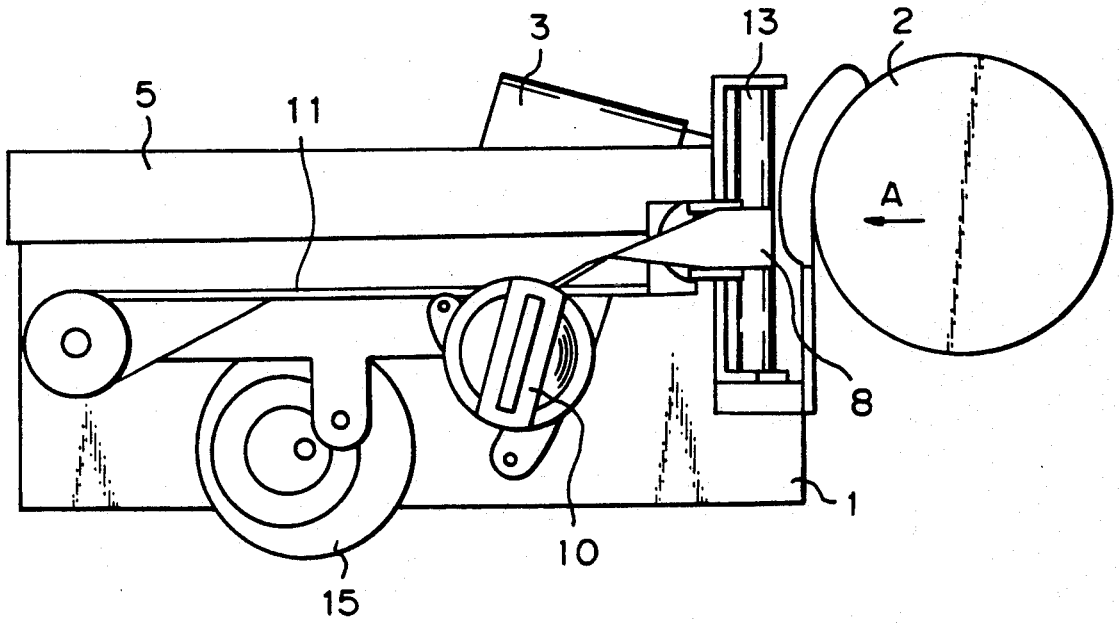
FIG. 3 is a side elevational view when seen from the take-up reel side in the ordinary recording mode.
Figure 4:
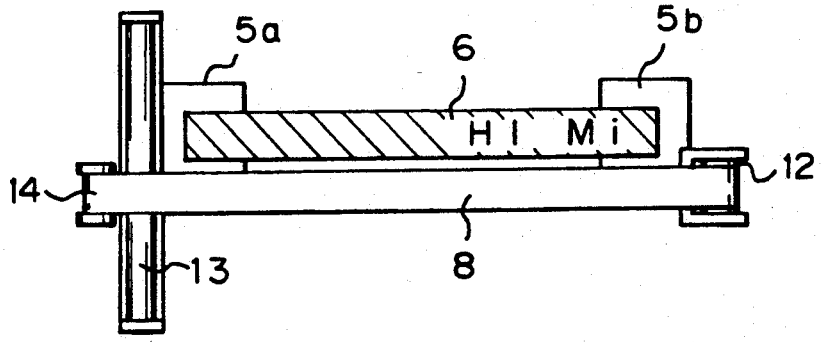
FIG. 4 is a diagram when seen from the direction indicated by an arrow A in FIG. 3.

In the ordinary recording mode, the rotary arm 11 is held in the horizontal state as shown in FIG. 3 and the correction ribbon 8 is located below the ink ribbon 6 as shown in FIG. 4. Therefore, by making the print hammer 3 operative in this state, the ordinary recording can be performed.

Figure 5:
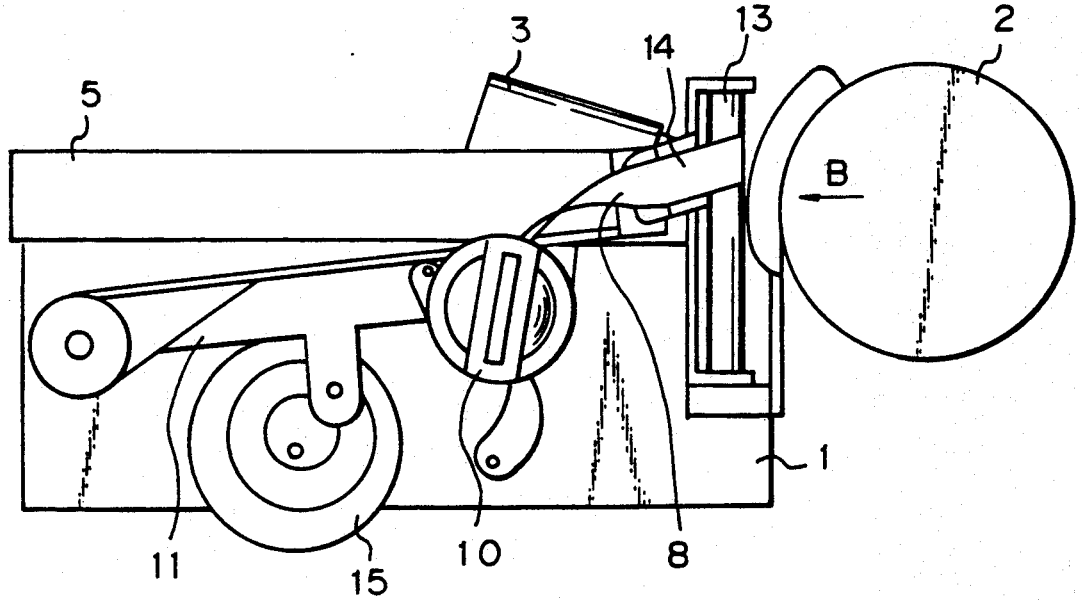
FIG. 5 is a side elevational view when seen from the take-up reel side in the correcting operation mode.
Figure 6:
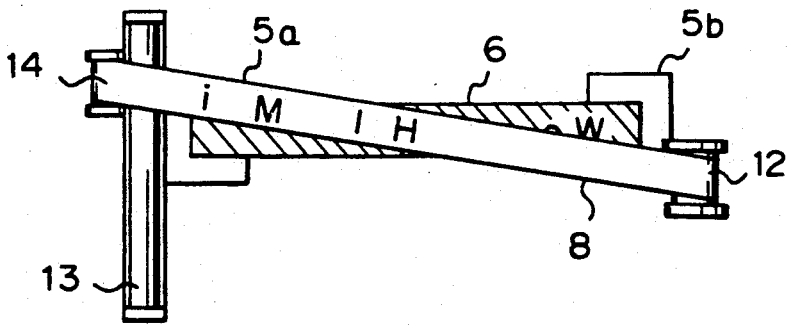
FIG. 6 is a diagram when seen from the direction indicated by an arrow B in FIG. 5.

On the contrary, in the correcting operation mode, as shown in FIG. 5, the cam 15 is rotated by a cam motor (not shown) to lift up the end of the rotary arm 11. Thus, the roller 14 moves upward. In this state, as shown in FIG. 6, the correction ribbon 8 crosses at the recording position of the ink ribbon 6 and on the side of the platen 2. If the print hammer 3 is made operative in this state, the correction ribbon 8 is struck through the ink ribbon 6, so that the correcting operation is performed.

Figure 7A:
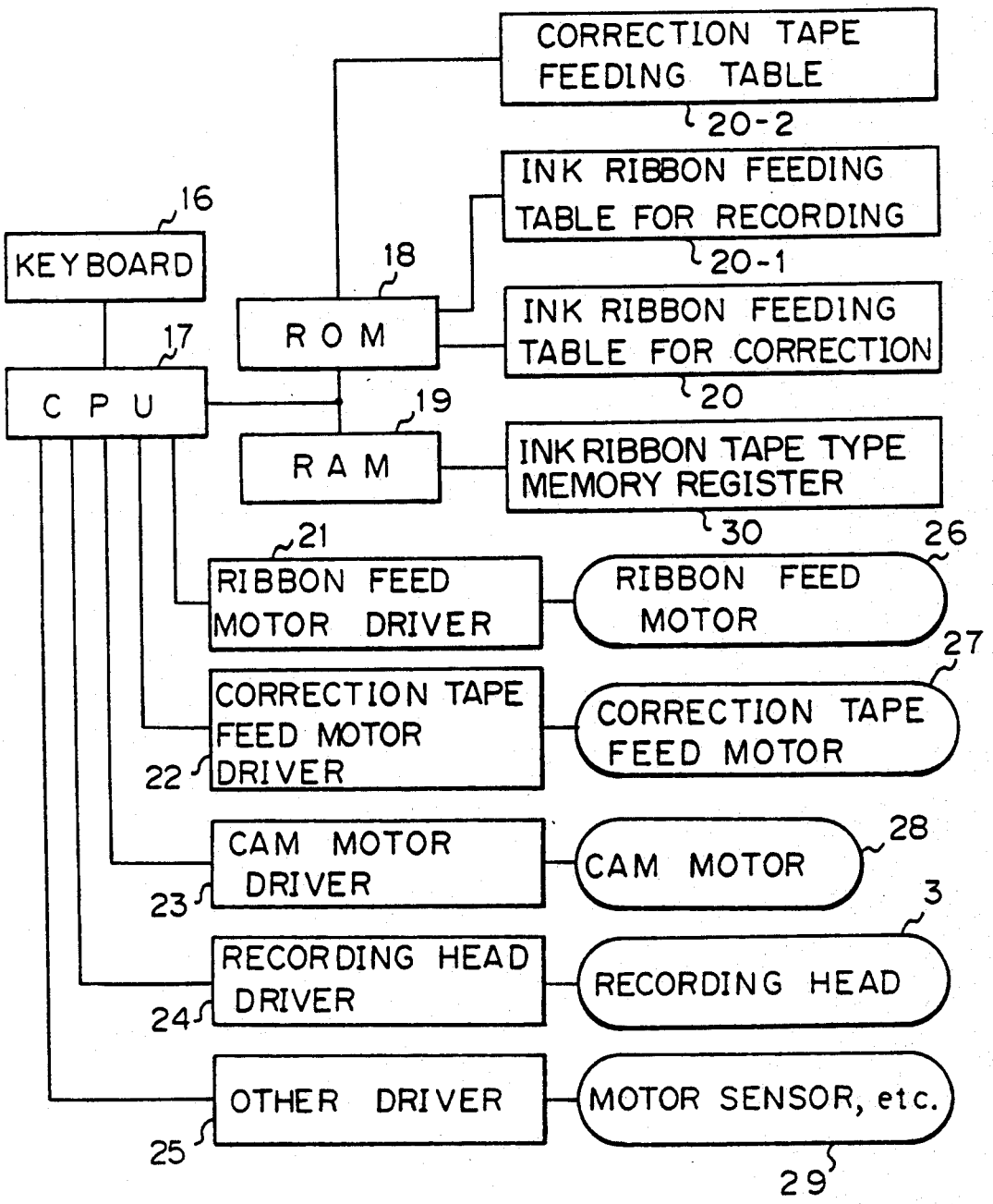
FIG. 7A is a block diagram of a control system for a mechanism in FIG. 1.

When the rotary arm 11 is lifted up and down once, the correction ribbon 8 is taken up to the take-up reel 10 by the amount of one character by a correction ribbon feed motor (shown as correction tape feed motor 27 in FIG. 7A).

A constitution of a control system of the whole recording apparatus for performing such a correcting operation will now be described.

A schematic arrangement of the control system is shown in FIG. 7A. Reference numeral 17 denotes a well-known CPU (central processing unit) to control the whole recording apparatus. In accordance with a control program stored in an ROM (read only memory) 18, the CPU 17 executes data processings by use of an RAM (random access memory) 19 in accordance with an input from a keyboard 16 and controls each mechanism of the recording apparatus.

Namely, the CPU 17 drives, for printing or erasing, through drivers 21 to 25, a ribbon feed motor 26 for taking up the ink ribbon 6, a correction tape feed motor 27 for taking up the correction tape 8, a cam motor 28 for rotating a cam 15 and shifting the correction tape 8, the recording head 3, a character selecting motor for rotating the daisy wheel 4, and motors or sensors (29) for driving other mechanisms.

In this embodiment, the ROM 18 has therein an ink ribbon feeding amount table 20 depending on the type of ink ribbon upon correction, a table 20-1 in which an ink ribbon feeding amount upon recording is stored, and a table 20-2 in which a correction tape feeding amount is stored.

A register 30 for storing the type of ink ribbon is provided in the RAM 19. For example, the RAM 19 automatically receives the information of the type of ink ribbon through the keyboard 16 or from a sensor or the like and can previously store this information into the register 30.

Figure 7B:
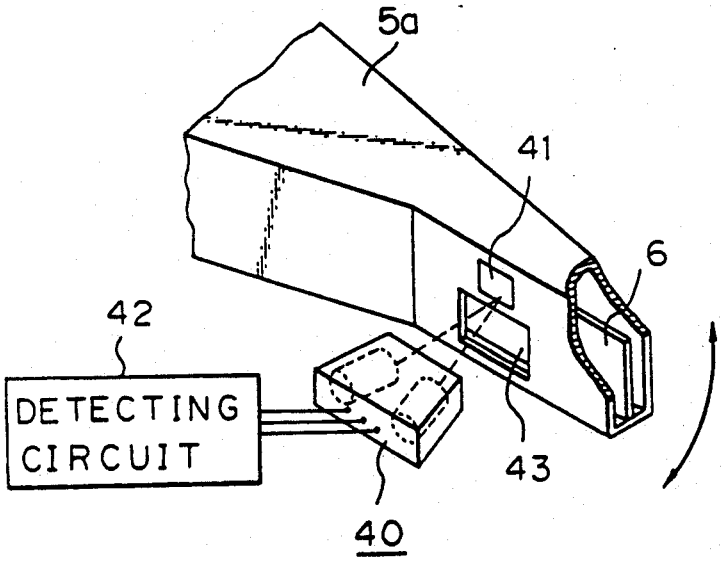
FIG. 7B is an explanatory diagram of an ink ribbon detecting mechanism.

To detect the type of ink ribbon, a mechanism as shown in FIG. 7B can be used. Numeral 5*a* denotes an arm supports the ink ribbon 6 of the ink ribbon cassette 5. The ink ribbon 6 passes in the arm 5*a*. The type of ink ribbon 6 is detected by a reflecting type photosensor 40. The ink ribbon cassette 5 swings in the directions indicated by arrows in FIG. 7B in accordance with the printing operation. When the cassette 5 swings to the lowest swing position (standby position), the photosensor 40 measures a change in reflectivity of a reflecting member 41 bonded to the inside of the arm 5*a*.

If the reflectivity or pattern of the reflecting member 41 is previously decided in accordance with the type of ink ribbon 6, the type of ink ribbon 6 provided in the cassette 5 can be detected by the photosensor 40.

On the other hand, at the upper end of the swing position of the ink ribbon cassette 5, the photosensor 40 scans the ink ribbon 6 in the cassette through a window 43. Therefore, if the reflecting member such as a metal foil or the like whose reflectivity is different from that of the ink ribbon 6 is bonded to the end region of the ink ribbon 6, the last end of the ink ribbon 6 can be also detected by the photosensor 40.

Figure 8:
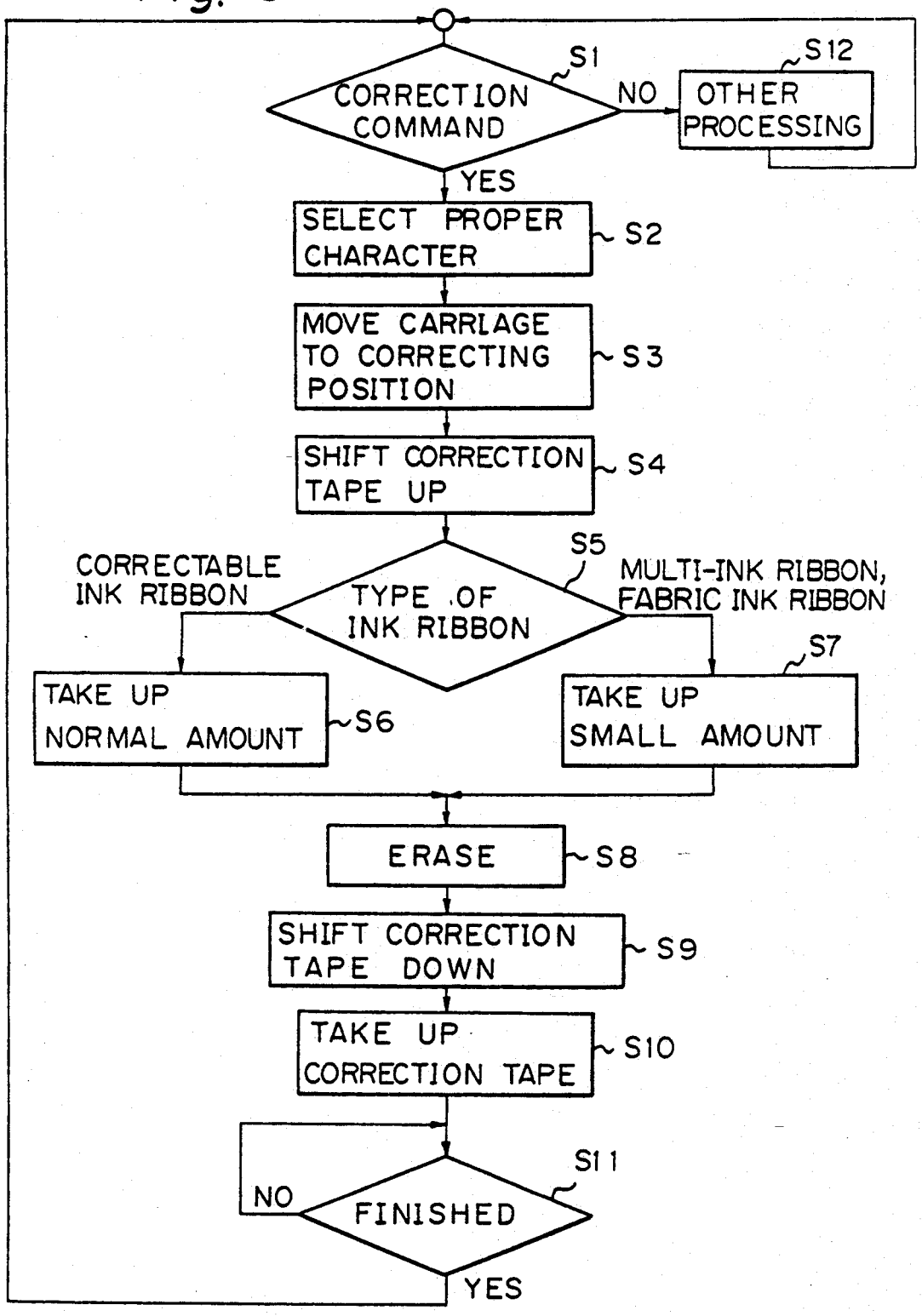
FIG. 8 is a flowchart for a control procedure of the control system in FIG. 7A.

In such an arrangement, when the CPU 17 receives a correction command by a key input from the keyboard 16, the CPU 17 executes the following control in accordance with a control procedure shown in a flowchart of FIG. 8.

First, in step S1, a check is made to see if the correction command has been input or not. If a command other than the correction command has been input, step S12 follows and the other processing such as, e.g., an operation for printing, carriage return, or the like is performed.

If the correction command has been input, step S2 follows and a proper type (character to be corrected) of the daisy wheel 4 is selected for correction and a motor to select the proper character is driven so that this correction type comes to the position where it can be struck by the recording head 3 for erasure.

In step S3, the carriage 1 is moved to the correcting position if necessary.

In the next step S4, the correction tape 8 is shifted up to the correcting position shown in FIGS. 5 and 6 by rotating the cam 15 by the cam motor 28.

To perform the correcting over the ink ribbon 6, the ink ribbon 6 is taken up by the ribbon feed motor 26 in order to prevent it from being damaged or cut-out. The ability of an ink ribbon to withstand repeated striking of a print hammer varies with the particular type of ink ribbon used.

Therefore, in step S5, the type of ink ribbon is detected on the basis of the content stored in the register 30. Upon correction, the feeding amount of the ink ribbon is variable to be set depending on type of ink ribbon on the basis of the content of the table 20.

For this purpose, in the embodiment, the types of ink ribbons are classified into two groups. In the case of the ordinary correctable ribbon, step S6 follows and the ink ribbon 6 is taken up by an amount such as not to be damaged or cut out. On the other hand, in the case of a multi ink ribbon or fabric ink ribbon having a relatively large strength, step S7 follows and the ink ribbon 6 is taken up by a smaller amount such as not to be damaged or cut out as compared with that in the case of the correctable ribbon.

In step S8, the erasure impacting operation of the print hammer 3 is executed, thereby erasing.

In the next step S9, the correction tape 8 is shifted down to the standby position by rotating the cam 15 by the cam motor 28. In step S10, the used portion of the correction tape 8 is taken up by the correction tape feed motor 27 for preparation of the next correction.

In Step S11, a check is made to see if a series of correcting operations have been finished or not. If YES, the processing routine is returned to step S1 and the apparatus waits for the input of the correction command.

In the foregoing embodiment, the feeding amount of the ink ribbon upon correction has been variably set in dependence on the type of ink ribbon, so that the multi ink ribbon or fabric ink ribbon can be efficiently used.

In the above embodiment, the correction ribbon has been fed after the correcting operation. However, a similar technique can also be applied to a system in which the correction ribbon is fed before the correction.

Figure 9:
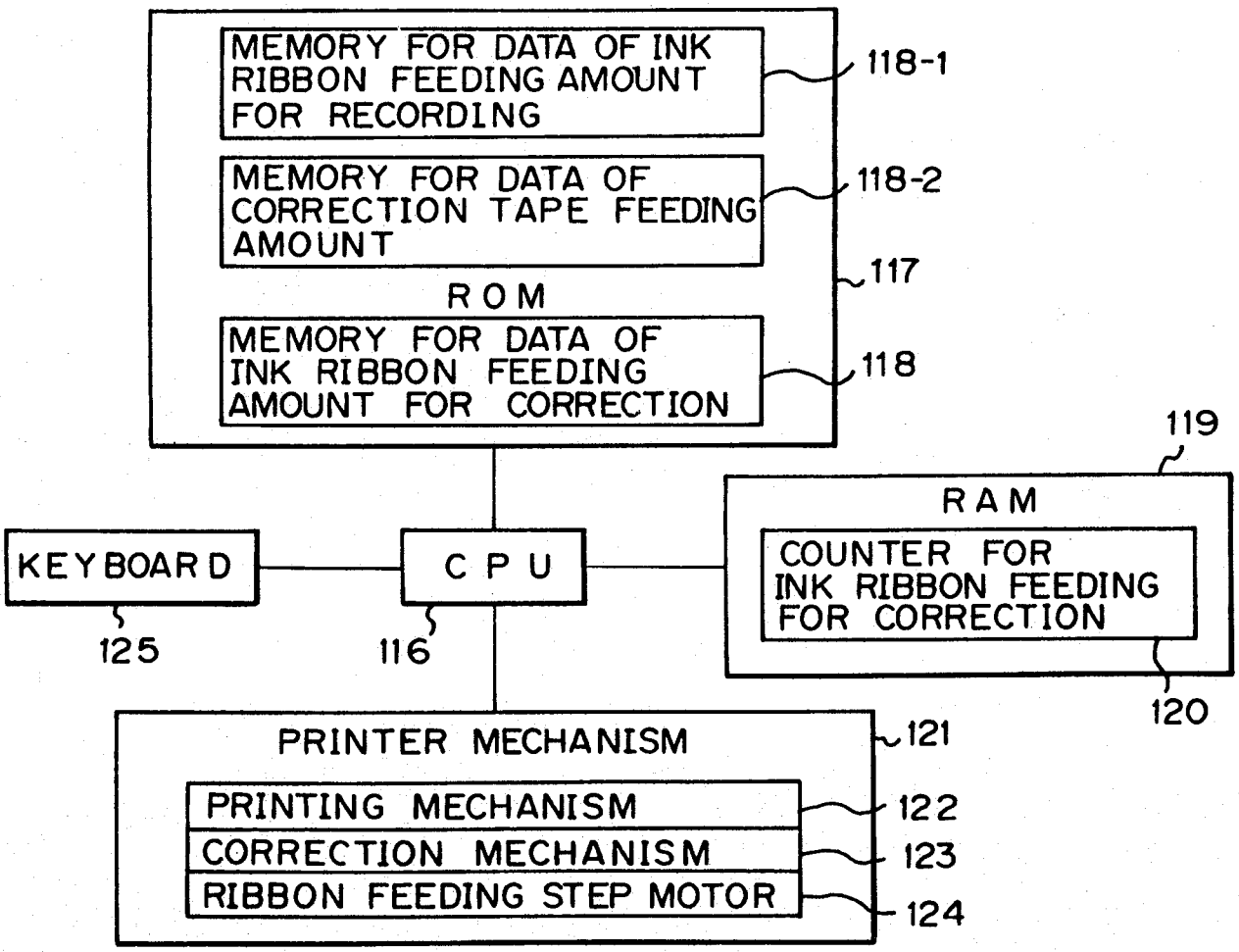
FIGS. 9 and 10 show another embodiment.
Figure 10:
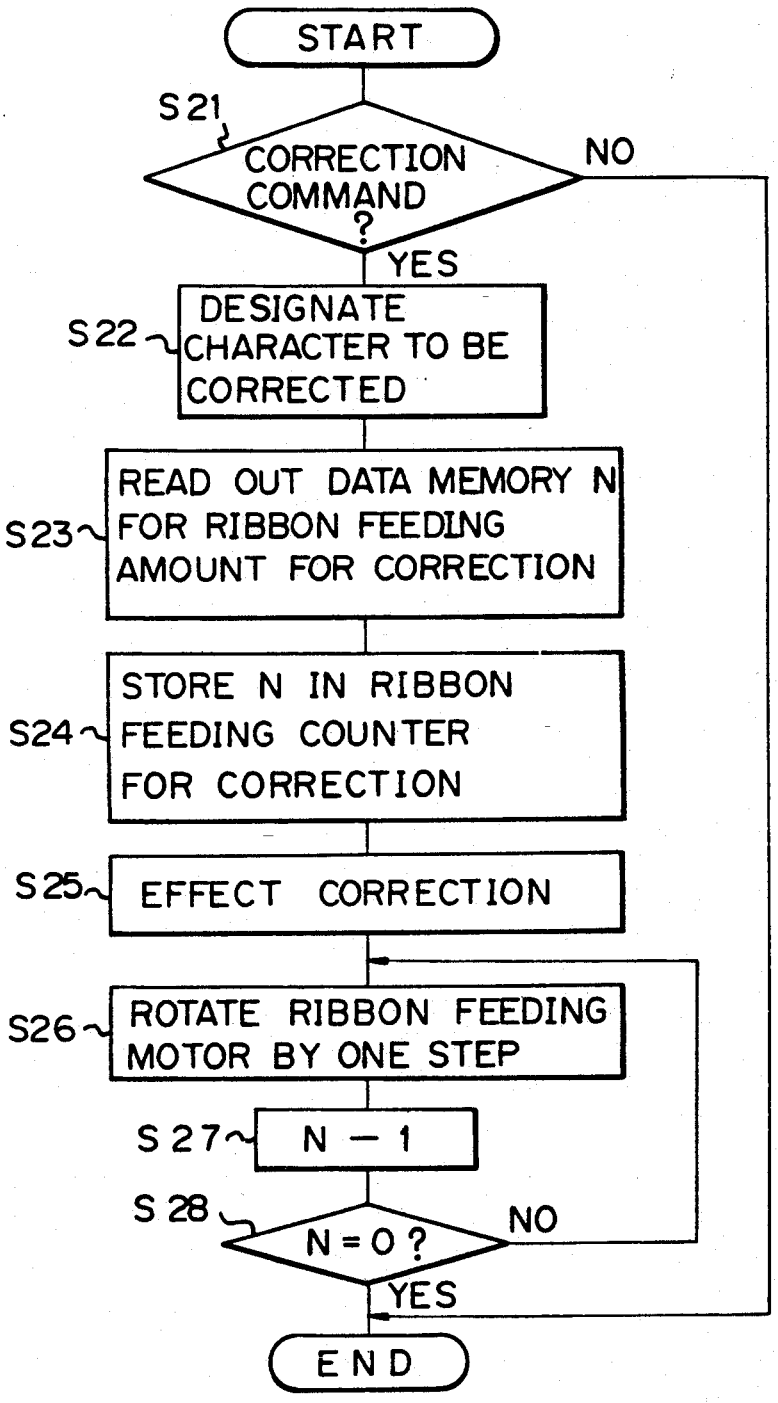

FIGS. 9 and 10 show another embodiment of the invention. In the foregoing embodiment, the feeding amount of the ink ribbon upon correction is variably set in accordance with the type of ink ribbon. However, in the second embodiment, the feeding amount of the ink ribbon upon correction is variably set in accordance with the recording content to be corrected. The second embodiment is substantially similar to the first embodiment and will also be understood by reference to FIGS. 1 to 7.

In this embodiment, when characters having different type widths (e.g., a capital letter "M" and a small letter "i" or the like) are corrected, a feeding amount of the ink ribbon for every correction is controlled by a feeding amount designation code corresponding to the type widths. This control is made to reduce an amount of ink ribbon which will be consumed when characters are corrected.

A control arrangement of the ink ribbon feeding amount upon correction of characters will now be explained hereinbelow.

FIG. 9 shows a control system of a recording apparatus having the recording mechanism shown in FIGS. 1 and 2.

In the diagram, reference numeral 116 denotes a CPU consisting of a microprocessor device or the like to control the whole apparatus in accordance with a control program, which will be explained, hereinafter, stored in an ROM 117. The ROM 117 has therein a memory 118 to store the data of the ink ribbon feeding amount for correction, a memory 118-1 to store the data of the ink ribbon feeding amount for recording, and a memory 118-2 to store the data of the feeding amount of the correction tape. For example, the ink ribbon feeding amount data for correction consists of eight bits of the binary number and sixteen states from 0 to 15 can be output. Each of the 16 output states corresponds to one step of a step motor 124 to drive a ribbon feeding mechanism. This step is determined in correspondence to each character to be corrected. The ink ribbon feeding amount for correction can be freely set. On the other hand, the feeding amount of the ink ribbon can be set to an arbitrary value within a range such as not to cause damage, cut-out, or the like of the ink ribbon. This feeding amount may be also set to a value smaller than the character width, so that no problem will occur even if the ink ribbon is fed so as to slightly overlap.

An RAM 119 includes therein a counter 120 for the ink ribbon feeding for correction.

A printer mechanism 121 has therein a printing mechanism 122 having the foregoing arrangement a correction mechanism 123, and the ribbon feeding step motor 124. A keyboard 125 is used to input various kinds of commands to the recording apparatus.

The control for the ink ribbon feeding amount which is executed by the CPU 116 upon correction will now be explained hereinbelow with reference to a flowchart in FIG. 10. A control procedure of FIG. 10 is stored as a program in the ROM 117.

In step S21, the CPU 116 checks to see if a correction command has been input or not. If YES, the character to be corrected is discriminated and designated in step S22.

In the next step S23, feeding amount data N corresponding to the type width of the character to be corrected is read out of the memory 118 in the ROM 117 in correspondence to the correcting character designated in step S22. The feeding amount data N is stored into the counter 120 in step S24.

In step S25, the correcting character is corrected by the correction mechanism. After completion of the correction, the step motor 124 is rotated by one step in step S26. The ink ribbon feeding amount data N stored in the counter 120 in step S24 is used when the rotation control is executed. The count value of the counter 120 is decreased by "1" every rotation of one step of the step motor 124 (step S27). When the count value becomes "0" (step S28), the rotation of the step motor 124 is stopped and the correcting routine is finished.

According to the foregoing arrangement since the ink ribbon is fed by the amount of every predetermined width in correspondence to the type width of the character to be corrected, the ink ribbon can be efficiently used within the minimum feeding amount range so as not to damage or cut out the ink ribbon. In addition, in this embodiment, since the correcting operation can be performed by shifting only the correction ribbon, the construction of the apparatus is simplified and the cost is low.

In the foregoing embodiment, the ribbon is taken out upon correction after the recording head was driven. However, the similar effects can be also obtained in an arrangement such that the preceding correcting character is stored and the ink ribbon is taken out prior to driving the recording head upon correction in accordance with the width of the preceding correcting character.

On the other hand, in both of the foregoing embodiments, only one side of the correction ribbon is lifted up or down and the other side is fixed, so that the up/down mechanism of the correction ribbon can be further simplified.

What is claimed is:

1. A printer using an ink ribbon and a correction ribbon for recording onto and correcting a recording medium, comprising:

ink ribbon mounting means for mounting the ink ribbon for recording onto a recording medium;

first conveying means for conveying the ink ribbon;

a correction ribbon mounting section capable of mounting the correction ribbon for erasing an image recorded on the recording medium;

second conveying means for conveying the correction ribbon;

displacing means for displacing the correction ribbon mounted on said correction ribbon mounting section between a correction position where the image is erased and a retracted position retracted from the correction position, said displacing means placing the correction ribbon between the recording medium and the ink ribbon when erasing the image;

impact means for impacting the correction ribbon against the recording medium through the ink ribbon to effect image erasing;

memory means having a first table for storing a feeding amount of the ink ribbon based on the type of ink ribbon during a recording operation, a second table for storing a feeding amount of the ink ribbon based on the type of ink ribbon during an erasing operation and a third table for storing a feeding amount of the correction ribbon during an erasing operation; and selecting means for selecting the feeding amount of the ink ribbon from the first table during the recording operation and conveying the ink ribbon by said first conveying means based on the feeding amount selected from the first table, and for selecting the feeding amount of the ink ribbon from the second table during the erasing operation and conveying the ink ribbon by said first conveying means based on the feeding amount selected from the second table and selecting the feeding amount of the correction ribbon from the third table during the erasing operation and conveying the correction ribbon by said second conveying means based on the feeding amount selected from the third table, wherein the feeding amount of the ink ribbon is less during the recording operation than during the erasing operation, and the feeding amount of a multi-ink ribbon or a fabric ink ribbon is less than that of a correctable ink during both the recording and erasing operations.

2. A printer according to claim 1, wherein the ink ribbon is conveyed by said first conveying means before said impact means impacts the correction ribbon.

3. A printer according to claim 1, wherein the ink ribbon is conveyed by said first conveying means after said impact means impacts the correction ribbon.

4. A printer according to claim 1, wherein said impact means records on the recording medium by striking the ink ribbon when the correction ribbon is in the retracted position.

5. A printer using an ink ribbon and a correction ribbon for recording onto and correcting a recording medium, comprising:

ink ribbon mounting means for mounting the ink ribbon for recording onto a recording medium;

first conveying means for conveying the ink ribbon;

a correction ribbon mounting section capable of mounting the correction ribbon for erasing an image recorded on the recording medium;

second conveying means for conveying the correction ribbon;

displacing means for displacing the correction ribbon mounted on said correction ribbon mounting section between a correction position where the image is erased and a retracted position retracted from the correction position, said displacing means placing the correction ribbon between the recording medium and the ink ribbon when erasing the image;

impact means for impacting the correction ribbon against the recording medium through the ink ribbon to effect image erasing;

memory means having a first table for storing a feeding amount of the ink ribbon based on the type of ink ribbon during a recording operation, a second table for storing a feeding amount of the ink ribbon based on the type of ink ribbon during an erasing operation and a third table for storing a feeding amount of the correction ribbon during an erasing operation; and selecting means for selecting the feeding amount of the ink ribbon from the first table during the recording operation and conveying the ink ribbon by said first conveying means based on the feeding amount selected from the first table, and for selecting the feeding amount of the ink ribbon from the second table during the erasing operation and conveying the ink ribbon by said first conveying means based on the feeding amount selected from the second table and selecting the feeding amount of the correction ribbon from the third table during the erasing operation and conveying the correction ribbon by said second conveying means based on the feeding amount selected from the third table, wherein

6. A printer according to claim 5, wherein the ink ribbon is conveyed by said first conveying means before said impact means impacts the correction ribbon.

7. A printer according to claim 5, wherein the ink ribbon is conveyed by said first conveying means after said impact means impacts the correction ribbon.

8. A printer according to claim 5, wherein said impact means records on the recording medium by striking the ink ribbon when the correction ribbon is in the retracted position.

9. A printer according to claim 5, wherein the feeding amount of the ink ribbon is less during the recording operation than during the erasing operation.

10. A printer according to claim 5, wherein the feeding amount of a multi-ink ribbon or a fabric ink ribbon is less than that of a correctable ink ribbon during both the recording and erasing operations.

* * * * *

UNITED STATES PATENT AND TRADEMARK OFFICE

CERTIFICATE OF CORRECTION

PATENT NO. : 5,197,813

DATED : March 30, 1993

INVENTOR(S) : Shinya Asano

It is certified that error appears in the above-indentified patent and that said Letters Patent is hereby corrected as shown below:

COLUMN 3:

Line 35, "recording head 3," should read --print hammer 3,--.
Line 53, "supports" should read --supporting--.

COLUMN 4:

Line 21, "recording head 3" should read --print hammer 3--.

Signed and Sealed this

Tenth Day of May, 1994

Bruce Lehman

BRUCE LEHMAN

*Commissioner of Patents and Trademarks*

*Attest:*

*Attesting Officer*